US006481250B1

(12) United States Patent
Kuo

(10) Patent No.: US 6,481,250 B1
(45) Date of Patent: Nov. 19, 2002

(54) LOCKING HEAD FOR A CABLE LOCK

(76) Inventor: Lambert Kuo, No. 16, Lane 459, Sec. 1, An Ho Rd., Tainan (TW)

( * ) Notice: Subject to any disclaimer, the term of this patent is extended or adjusted under 35 U.S.C. 154(b) by 0 days.

(21) Appl. No.: 09/952,973

(22) Filed: Sep. 14, 2001

(51) Int. Cl.[7] ..... E05B 67/06
(52) U.S. Cl. ..... 70/49; 70/52; 70/54; 70/367
(58) Field of Search ..... 70/49, 52–56, 70/18, 30, 283, 455, 367, 370, 373

(56) References Cited

U.S. PATENT DOCUMENTS 4,584,855 A * 4/1986 Burlingame ..... 70/39 X
4,819,464 A * 4/1989 Kuo ..... 70/49 X
4,831,849 A * 5/1989 Kortenbrede ..... 70/49
5,010,746 A * 4/1991 Zane et al. ..... 70/39
5,406,810 A * 4/1995 Chen ..... 70/49 X
5,447,043 A * 9/1995 Hwang ..... 70/49
5,535,609 A * 7/1996 Kuo ..... 70/52 X
5,706,679 A * 1/1998 Zane et al. ..... 70/49 X
5,752,416 A * 5/1998 Nien ..... 70/49 X
5,761,934 A * 6/1998 Kuo ..... 70/49
5,791,169 A * 8/1998 Kuo ..... 70/52 X
5,829,280 A * 11/1998 Chen ..... 70/49
5,832,762 A * 11/1998 McDaid ..... 70/455
5,937,678 A * 8/1999 Kuo ..... 70/49 X
6,026,664 A * 2/2000 Lin ..... 70/49

* cited by examiner

*Primary Examiner*—Suzanne Dino Barrett
(74) *Attorney, Agent, or Firm*—Jackson Walker L.L.P.

(57) ABSTRACT

A locking head is composed of a body and a casing. The body has a locking core with a keyhole. A locking hole is defined at an outer periphery of the body. The casing is composed of a housing and an end cover. The body is inserted into the housing through a large opening in one end of the housing and the housing has an small opening defined in the other end. A latch opening is defined through the housing and aligns with the locking hole. A plurality of catches is formed in housing and extends out from the large opening. The end cover has a hole aligned with the keyhole and a plurality of slots defined in an inner wall. The catches are respectively attached to the slots to attach the end cover to the housing and securely hold the body in the casing.

5 Claims, 6 Drawing Sheets

LOCKING HEAD FOR A CABLE LOCK

BACKGROUND OF THE INVENTION

1. Field of the Invention

The present invention is related to a lock, and more particularly to a locking head for a cable lock.

2. Description of Related Art

Referring to FIGS. 6–8, a conventional cable lock has a locking head (4) and a cable (60). The locking head (4) consists of a body (40) and a casing (50). The body (40) is mounted in the casing (50). A lock core (41) is mounted in the body (40), and a keyhole (42) is defined in the lock core (41). A locking hole (43) is radially defined through an outer periphery of the body (40). The cable (60) has a proximal end attached to the body (40) and a distal end with a latched head (61) formed on the distal end. When the lock is locked, the latched head (61) is fastened in the locking hole (43).

The casing (50) is composed of a housing (51) and an end cover (52). The housing (51) is essentially a hollow tube with two ends. A large opening is formed in one end, and a small opening (511) is formed in the other end. The body (40) is inserted into the housing (51) through the large opening, and the cable (60) extends through the small opening (511). A latch opening (512) is radially defined through the housing (21) and is aligned with the locking hole (43). A hole (521) is defined through the end cover (52) and aligned with the keyhole (12). An annular flange (513) is formed around the large opening in the housing (51). A shoulder (522) formed on the inside of the end cover (52) fits over the annular flange (512).

During assembly, the body (40) is mounted in the housing (51), and the end cover (52) is attached to the housing (51) by ultrasonic welding or high-frequency welding.

However, welding the circular housing (51) and the end cover (52) is difficult, and the bond between them is generally not very strong. Consequently, the end cover (52) can easily detach from the housing (51). Furthermore, mounting the cylindrical body (40) in the cylindrical housing (51) with the keyhole (42) aligned with the hole (521) in the end cover (52) and the locking hole (43) aligned with the latch opening (512) at the same time is almost impossible. Thus, the body (40) must be repeatedly adjusted. Moreover, because the body (40) is not held firmly in the housing (51) and can be turned inside the housing (51), the keyhole (42) may be offset from the hole (521) in the end cover in use.

The invention provides an improved locking head to mitigate and/or obviate the aforementioned problems.

SUMMARY OF THE INVENTION

The main objective of the invention is to provide a locking head that is easy to manufacture.

Another objective of the invention is to provide a locking head in which the body is securely held in position in the housing.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
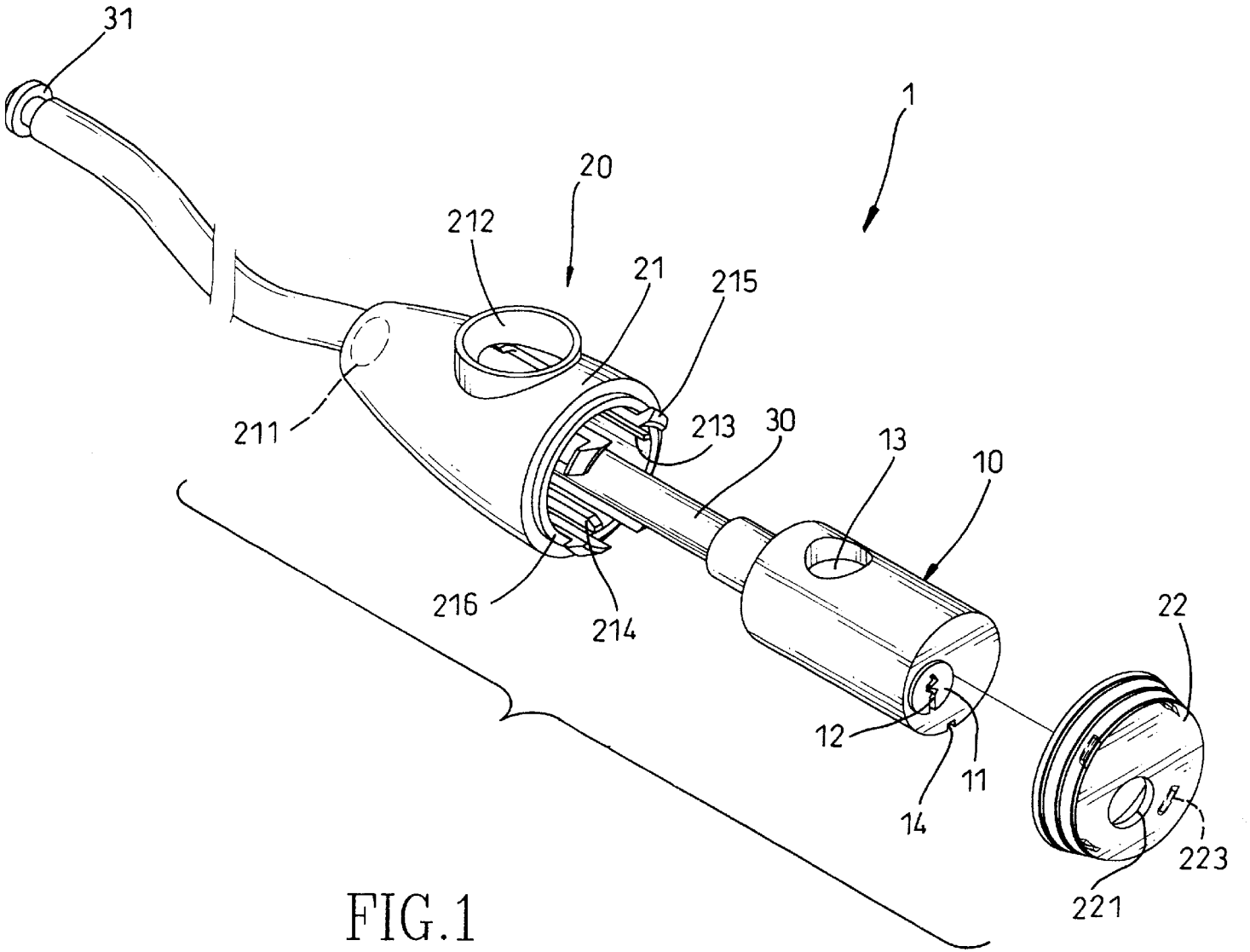
FIG. 1 is an exploded perspective view of a cable lock in accordance with the present invention.
Figure 2:
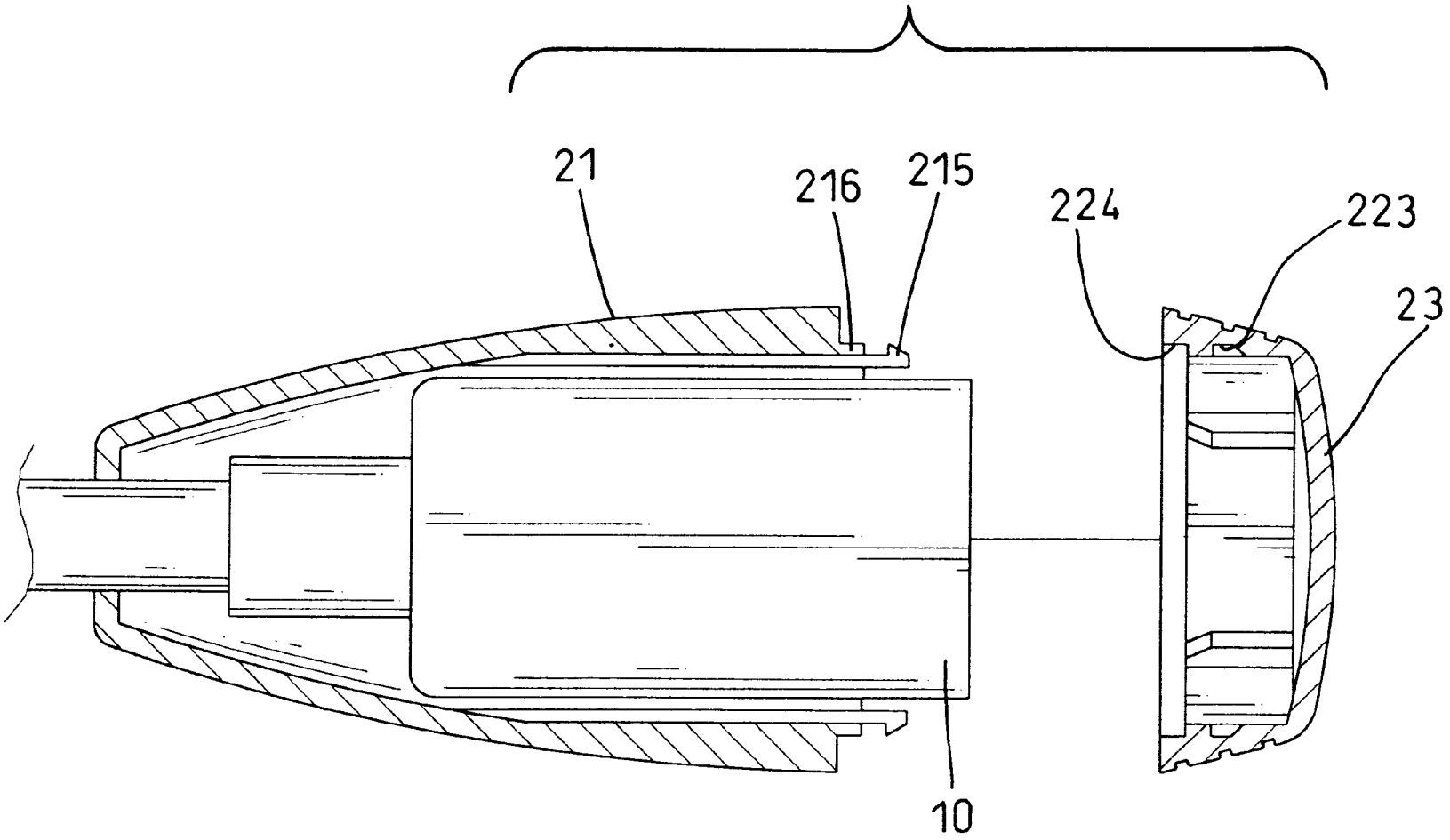
FIG. 2 is a cross-sectional view of a locking head of the cable lock with the end cover detached in accordance with the present invention.
Figure 4:
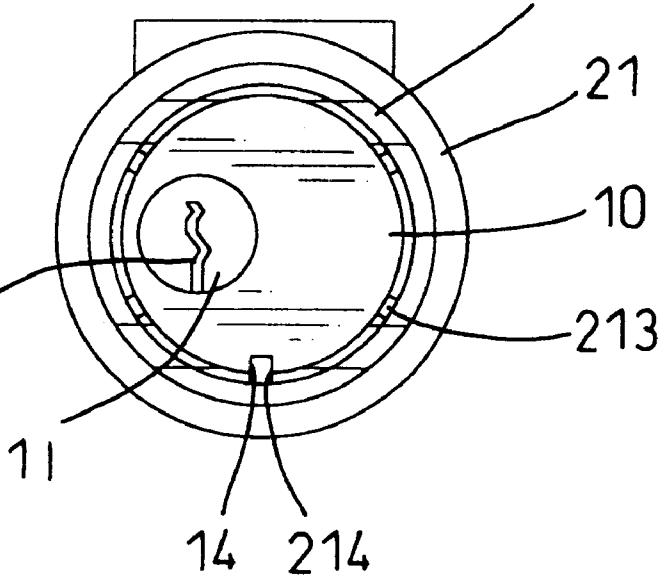
FIG. 4 is a front view of the locking head.

With reference to FIGS. 1, 2, 3 and 4, a locking head (1) in accordance with the present invention in a cable lock comprises a body (10) and a casing (20). The body (10) is mounted in the casing (20).

The body (10) is cylindrical and has two ends. One end is securely attached to a cable (30). A lock core (11) is mounted in the other end, and a keyhole (12) is defined in an outer end of the lock core (11). A locking hole (13) is radially defined through an outer periphery of the body (10), and a keyway (14) is longitudinally defined in the outer periphery of the body (10). A latched head (31) is formed at a distal end of the cable (30).

Figure 3:
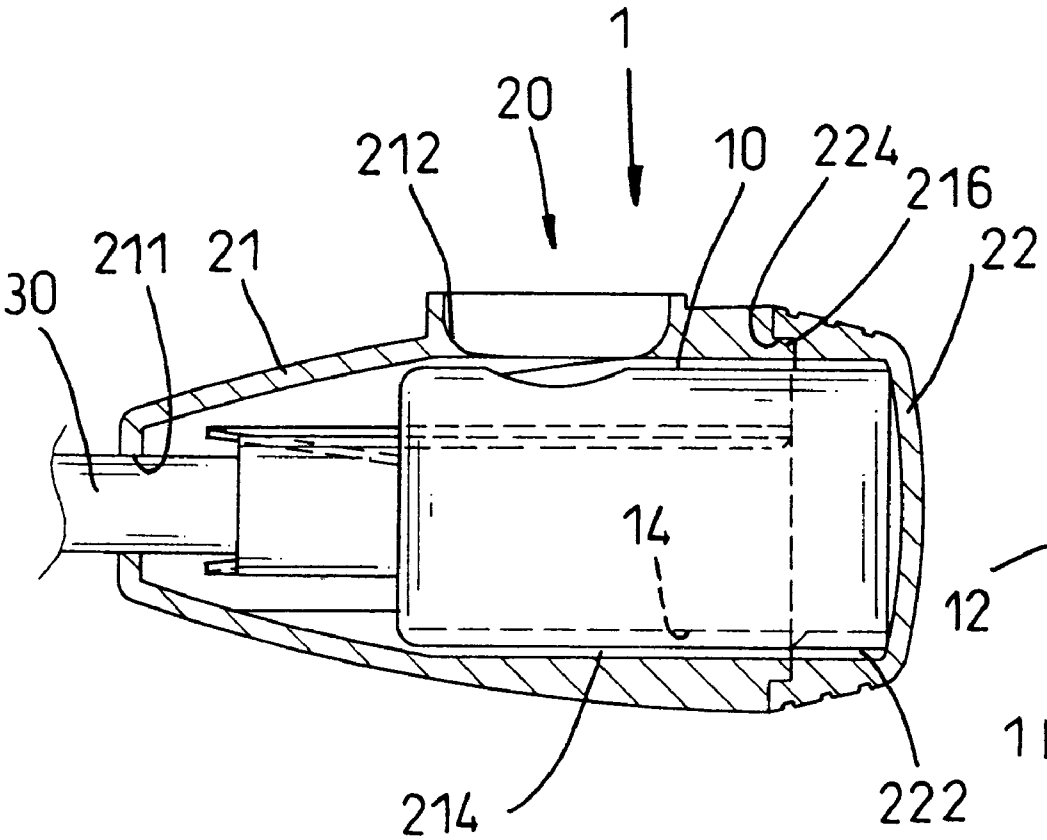
FIG. 3 is a side view in partial section of the locking head.

The casing (20) is composed of a housing (21) and an end cover (22). The casing has two ends with a large opening at one end and a small opening (211) at the other end. The end cover (52) has a flat outside face with a skirt (225) around the outside face forming a recessed inside face. The body (10) is inserted in the housing (21) through the large opening, and the cable (30) extends through the small opening (211). A latch opening (212) is radially defined through the housing (21) and is aligned with the locking hole (13). A key (214) is longitudinally formed in the housing (21) and mates with the keyway (14) in the body (10) to prevent the body (10) from turning in the housing (21). A plurality of catches (215) is longitudinally formed in the housing (21) and extends out from the large opening in the housing (21). Each catch (215) has a hook (2150) formed on a face end thereof. The end cover (22) has slots (223) defined in a bottom face of the skirt of the end cover (22), and the catches (215) extend through the slots (223) to attach the end cover (22) to the housing (21). A plurality of first positioning ribs (213) is longitudinally formed beside the catches (215). With reference to FIG. 3, a plurality of second positioning ribs (222) is also longitudinally formed beside the slots (223) in the end cover (22). An annular flange (216) is formed around the large opening in the housing (21) and is mounted in a shoulder (224) formed on the inside of the end cover (22). A hole (221) is defined through the face of the end cover (22) and is aligned with the keyhole (12).

Figure 5:
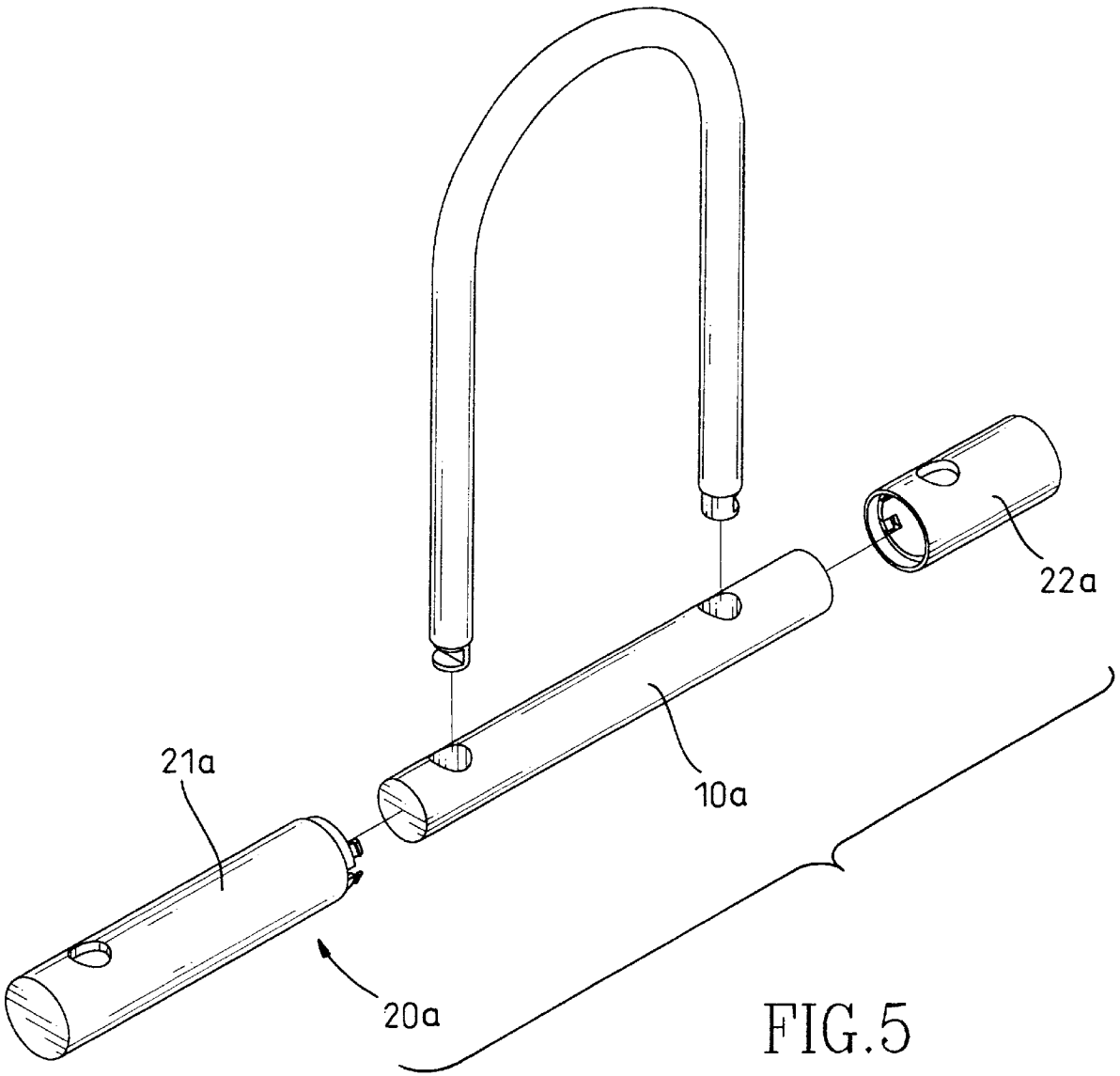
FIG. 5 is a perspective view of a U-shaped lock with the locking head in accordance with the present invention.
Figure 6:
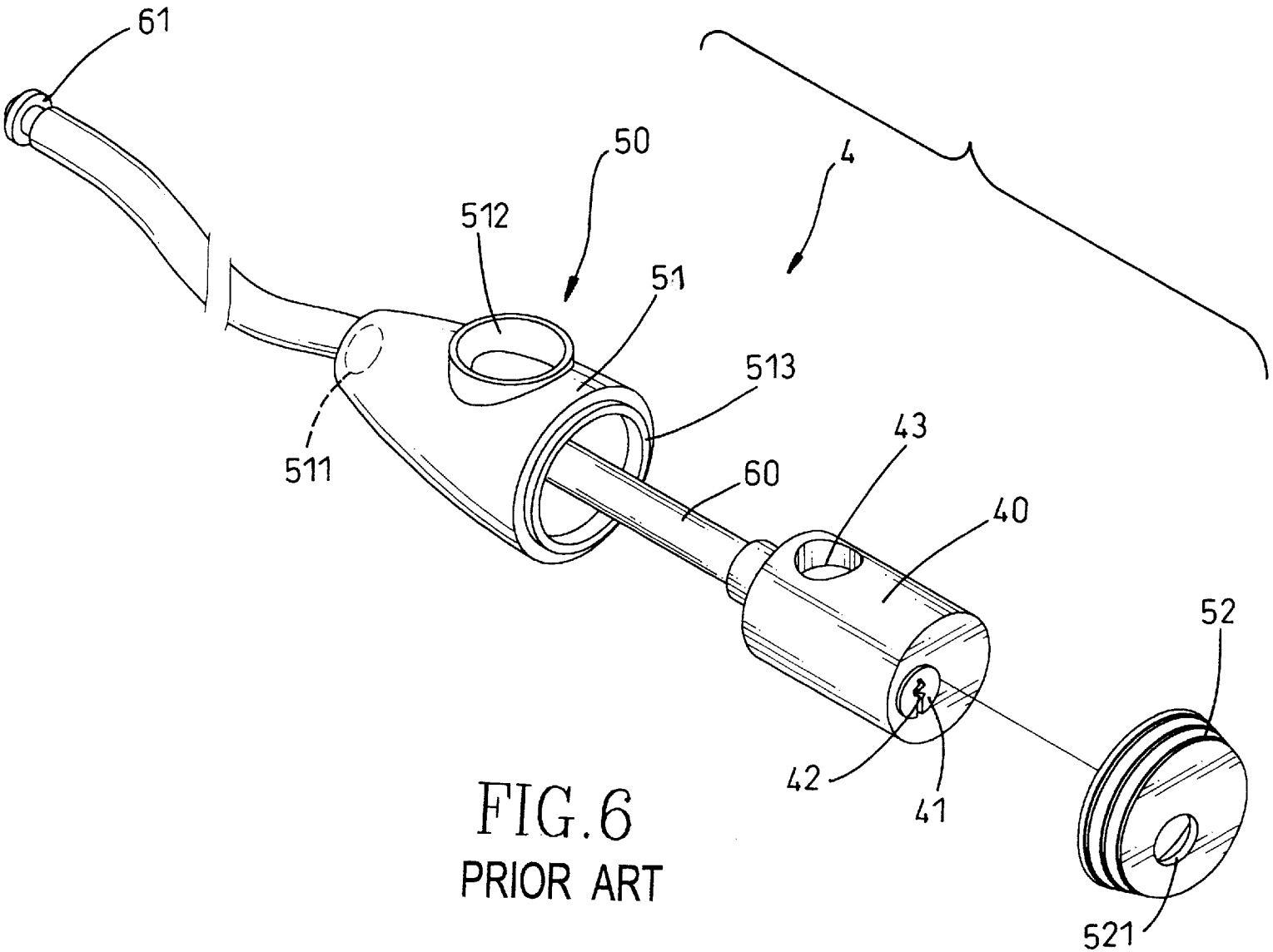
FIG. 6 PRIOR ART
FIG. 6 is an exploded perspective view of a conventional cable lock.
Figure 8:
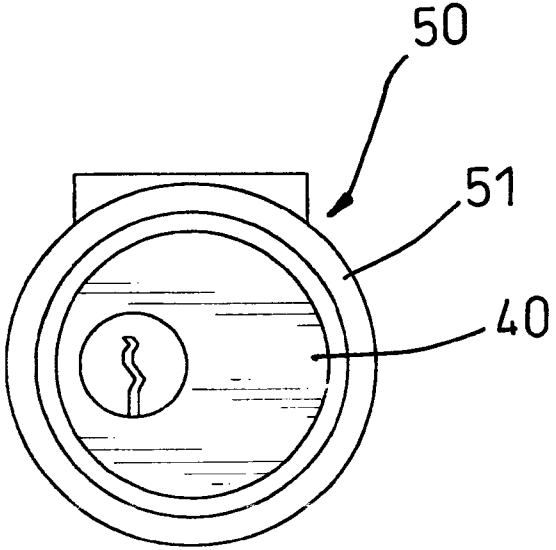
FIG. 8 PRIOR ART
FIG. 8 is a front view of the locking head in FIG. 6.
Figure 7:
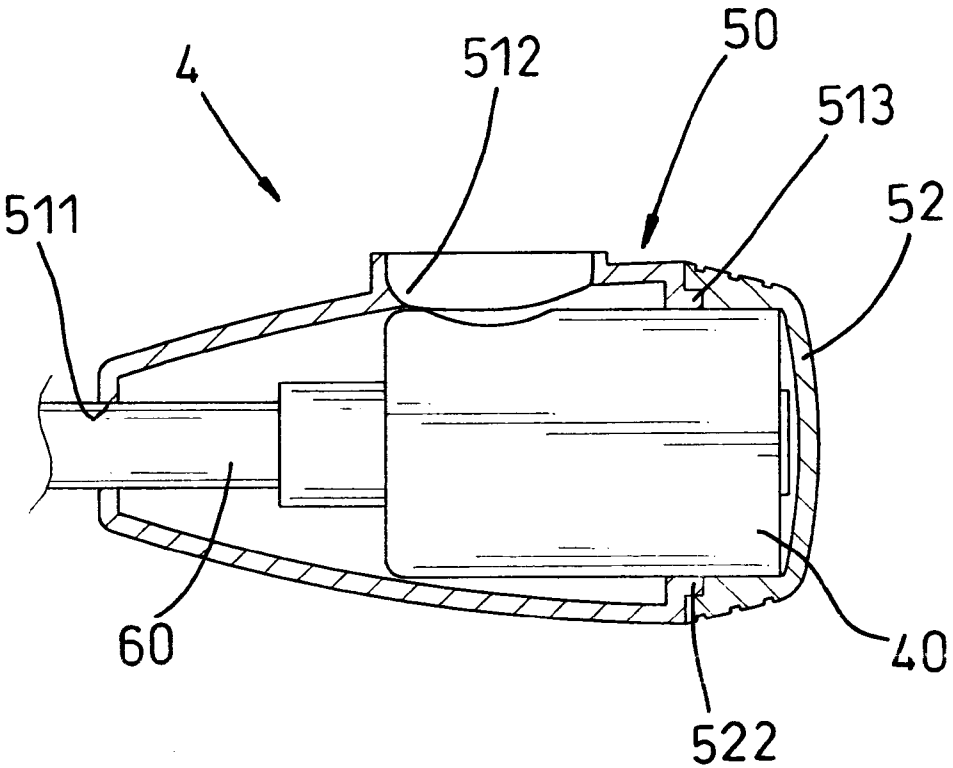
FIG. 7 PRIOR ART
FIG. 7 is a side view in partial section of a locking head of the conventional cable lock in FIG. 6.

With reference to FIG. 5, another embodiment of the locking head in accordance with the invention can be used with a U-shaped lock. The locking head has a body (10*a*) with two locking holes. The casing (20*a*) has a housing (21*a*) with a first latch opening and an end cover (22*a*) with a second latch opening. The openings are respectively aligned with the locking holes. A keyhole (not shown or numbered) is defined at an end of the body (10*a*) facing the end cover (22*a*). The remaining elements of this embodiment are similar to the aforementioned cable lock and are not further described.

The locking head as described has the following advantages:

1. It is very easy and convenient to attach the end cover (22) to the housing (21) by attaching the catches (215) to the slots (223) without welding.

2. By inserting the key (214) into the keyway (14), the correct position of the body (10) to align the keyhole (12) with the hole (221) and the locking hole (13) to the latch opening (212) is assured.

3. The body (10) is securely held and locked in position by the ribs (213, 214, 222) and will not turn in the housing (21).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A locking head comprising:

a body (10), the body (10) having a lock core (11) mounted in the body (10), a keyhole (12) defined in the lock core (11), at least one locking hole (13) radially defined through an outer periphery of the body (10) and a keyway (14) longitudinally defined in an outer periphery of the body (10); and a casing (20) comprising a housing (21) and an end cover (22), the housing (21) having two ends with a first opening on one end and receiving the body (10) through the first opening, at least one latch opening (212) radially defined through the housing (21) and aligned with the locking hole (13), a key (214) longitudinally formed in the housing (21) to correspond to the keyway (14) of the body (10) and a plurality of catches (215) longitudinally formed in the housing (21) and extending out from the large opening, and the end cover (22) having a hole (221) aligned with the keyhole (12) and slots (223) defined in a flat outside face of the end cover (22) to correspond to the catches (215), wherein each catch (215) has a hook (2150) formed on a free end thereof, whereby the hooks (2150) of the catches (215) engage a periphery defining the slots (223) to attach the end cover (22) to the housing (21) and hold the body (10) in the casing (20), and the key is received in the keyway so as to prevent relative rotation between the housing (21) and the body (10) after the body (10) is received in the housing (21).

2. The locking head as claimed in claim 1, wherein the housing (21) further has a plurality of first positioning ribs (213) longitudinally formed beside the catches (215); and the end cover (22) further has a plurality of second positioning ribs (222) longitudinally formed therein.

3. The locking head as claimed in claim 2, wherein the housing (21) has an annular flange (216) formed around the first opening; and the end cover (22) has a shoulder (224) to receive the flange (216).

4. The locking head as claimed in claim 2, wherein the body (10) has two locking holes, and the housing (21) has two latch openings aligned with the locking holes respectively.

5. The locking head as claimed in claim 2, wherein the body has two locking holes, and the housing (21) has a latch opening aligned with one of the locking holes, and the end cover (22) has a latch opening aligned with the other of the locking holes.

* * * * *